US008683823B1

(12) United States Patent
Shivers, III et al.

(10) Patent No.: US 8,683,823 B1
(45) Date of Patent: Apr. 1, 2014

(54) SYSTEM FOR OFFSHORE LIQUEFACTION

(71) Applicant: FLNG, LLC, Houston, TX (US)

(72) Inventors: Robert Magee Shivers, III, Houston, TX (US); Richard Paul Michel, Houston, TX (US); Marcus LaRoy Morris, Katy, TX (US); Ned Phillip Baudat, New Braunfels, TX (US); Norman Paul Kolb, Houston, TX (US)

(73) Assignee: FLNG, LLC, Houston, TX (US)

( * ) Notice: Subject to any disclaimer, the term of this patent is extended or adjusted under 35 U.S.C. 154(b) by 0 days.

(21) Appl. No.: 14/134,634

(22) Filed: Dec. 19, 2013

Related U.S. Application Data

(63) Continuation-in-part of application No. 14/035,642, filed on Sep. 24, 2013, which is a continuation-in-part of application No. 13/848,002, filed on Mar. 20, 2013.

(51) Int. Cl.

| | |
|---|---|
| ***F17C 3/08*** | (2006.01) |
| ***F17C 7/02*** | (2006.01) |
| ***F17C 13/08*** | (2006.01) |
| ***F25J 1/00*** | (2006.01) |
| ***B63B 22/02*** | (2006.01) |
| ***E02B 3/24*** | (2006.01) |

(52) U.S. Cl.
USPC ..... 62/611; 62/45.1; 62/50.1; 62/53.2; 62/606; 114/230.14; 114/230.17

(58) Field of Classification Search
USPC ..... 62/52.3, 606, 611, 613, 45.1, 50.1, 62/50.2; 114/230.14, 230.17, 387
See application file for complete search history.

(56) References Cited

U.S. PATENT DOCUMENTS

| | | | | |
|---|---|---|---|---|
| 4,317,474 | A | 3/1982 | Kentosh | |
| 4,433,940 | A | 2/1984 | Harrison | |
| 5,025,860 | A * | 6/1991 | Mandrin | 166/267 |
| 5,878,814 | A | 3/1999 | Breivik et al. | |
| 5,983,931 | A | 11/1999 | Ingebrigtsen et al. | |
| 6,003,603 | A * | 12/1999 | Breivik et al. | 166/357 |
| 6,412,302 | B1 | 7/2002 | Foglietta | |
| 6,530,241 | B2 * | 3/2003 | Pozivil | 62/619 |
| 6,793,712 | B2 | 9/2004 | Qualls | |
| 6,889,522 | B2 * | 5/2005 | Prible et al. | 62/611 |
| 6,973,948 | B2 | 12/2005 | Pollack et al. | |
| 6,997,643 | B2 | 2/2006 | Willie et al. | |
| 7,007,623 | B2 * | 3/2006 | Boatman et al. | 114/230.15 |
| 7,080,673 | B2 | 7/2006 | Pollack et al. | |
| 7,237,391 | B1 * | 7/2007 | Shivers, III | 62/53.2 |
| 7,318,319 | B2 | 1/2008 | Hubbard et al. | |
| 7,360,367 | B2 | 4/2008 | Hubbard et al. | |
| 7,478,975 | B2 * | 1/2009 | Hubbard et al. | 405/210 |
| 7,600,396 | B2 | 10/2009 | Mak | |

(Continued)

OTHER PUBLICATIONS

Sevan, Jan. 30, 2013, "Overcoming the key challenges for floating production and drilling in arctic environments".

*Primary Examiner* — Frantz Jules
*Assistant Examiner* — Keith Raymond
(74) *Attorney, Agent, or Firm* — Buskop Law Group, PC; Wendy Buskop

(57) ABSTRACT

A system for offshore liquefaction of natural gas and transport of produced liquefied natural gas using a moored floating production storage and offloading vessel, fluidly connected with a flexible conduit to a moored floating disconnectable turret which can be connected and reconnected to a floating liquefaction vessel with onboard liquefaction unit powered by a dual fuel diesel electric main power plant.

4 Claims, 8 Drawing Sheets

(56) References Cited

U.S. PATENT DOCUMENTS

| | | | | |
|---|---|---|---|---|
| 7,673,577 | B2 * | 3/2010 | Poldervaart et al. | 114/230.1 |
| 7,717,762 | B2 * | 5/2010 | Boatman et al. | 441/3 |
| 7,958,835 | B2 | 6/2011 | Srinivasan | |
| 8,037,694 | B2 | 10/2011 | Runbalk | |
| 8,100,076 | B1 * | 1/2012 | Shivers et al. | 114/230.14 |
| 8,104,416 | B1 | 1/2012 | Shivers et al. | |
| 2007/0095427 | A1 | 5/2007 | Ehrhardt et al. | |
| 2008/0166936 | A1 * | 7/2008 | Lindblade | 441/3 |
| 2010/0108145 | A1 | 5/2010 | Danaczko et al. | |
| 2010/0175424 | A1 | 7/2010 | Walther | |
| 2011/0113825 | A1 * | 5/2011 | Neeraas et al. | 62/613 |
| 2011/0265494 | A1 * | 11/2011 | Barclay | 62/45.1 |
| 2012/0024391 | A1 | 2/2012 | Wille et al. | |
| 2012/0317996 | A1 | 12/2012 | Lee | |
| 2013/0025726 | A1 | 1/2013 | Dupont | |

* cited by examiner 10
11
12
208
78b
7
8
78a
404
19
76b
404
440
16
76a
22a
22b
22c
22d
26
28
24
25
21
75

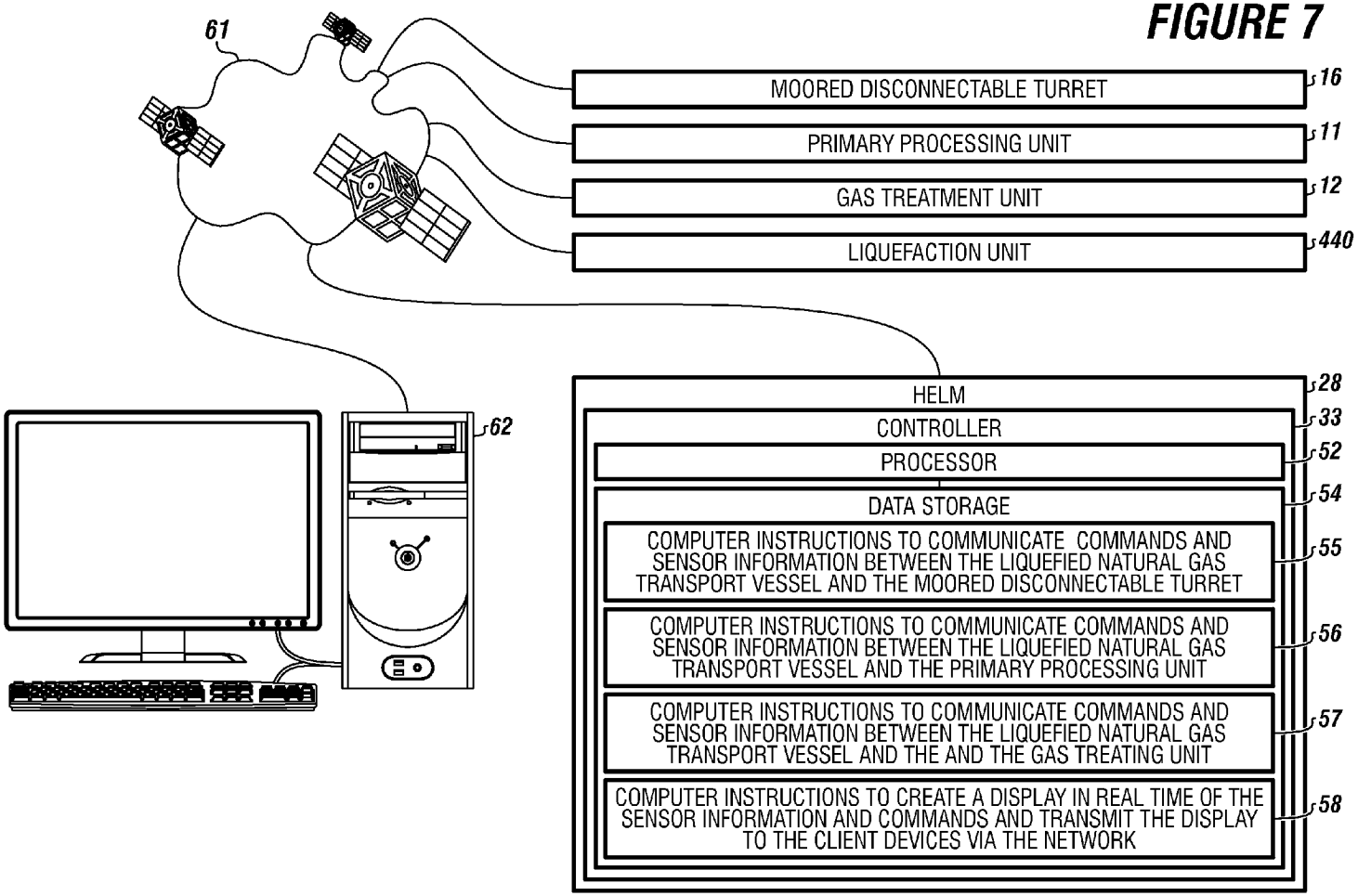
FIGURE 7
16
MOORED DISCONNECTABLE TURRET
11
PRIMARY PROCESSING UNIT
12
GAS TREATMENT UNIT
440
LIQUEFACTION UNIT
28
HELM
33
CONTROLLER
52
PROCESSOR
54
DATA STORAGE
55
COMPUTER INSTRUCTIONS TO COMMUNICATE COMMANDS AND SENSOR INFORMATION BETWEEN THE LIQUEFIED NATURAL GAS TRANSPORT VESSEL AND THE MOORED DISCONNECTABLE TURRET
56
COMPUTER INSTRUCTIONS TO COMMUNICATE COMMANDS AND SENSOR INFORMATION BETWEEN THE LIQUEFIED NATURAL GAS TRANSPORT VESSEL AND THE PRIMARY PROCESSING UNIT
57
COMPUTER INSTRUCTIONS TO COMMUNICATE COMMANDS AND SENSOR INFORMATION BETWEEN THE LIQUEFIED NATURAL GAS TRANSPORT VESSEL AND THE AND THE GAS TREATING UNIT
58
COMPUTER INSTRUCTIONS TO CREATE A DISPLAY IN REAL TIME OF THE SENSOR INFORMATION AND COMMANDS AND TRANSMIT THE DISPLAY TO THE CLIENT DEVICES VIA THE NETWORK
61
62

SYSTEM FOR OFFSHORE LIQUEFACTION

CROSS REFERENCE TO RELATED APPLICATIONS

The present application is a Continuation in Part and claims priority to co-pending U.S. patent application Ser. No. 14/035,642 filed on Sep. 24, 2013, entitled "METHOD FOR OFFSHORE LIQUEFACTION," which is a Continuation in Part and claims priority to co-pending U.S. patent application Ser. No. 13/848,002 filed on Mar. 20, 2013, entitled "METHOD FOR LIQUEFACTION OF NATURAL GAS OFFSHORE." These references are hereby incorporated in their entirety.

FIELD

The present embodiments generally relate to a system for vessel power assisted liquefaction of natural gas offshore.

BACKGROUND

A need exists for a cost effective system of liquefying natural gas system using a transport ship capable of reliable operation in moderate to severe metocean conditions, enabling the transport ship to quickly attach and detach from a moored turret and to transit to sheltered water and discharge its cargo to a trading tanker.

A need exist for a system using a floating liquefaction vessel that utilizes vessel power to liquefy the natural gas.

A need exists for a system to improve the fuel efficiency of dual nitrogen expansion processes for liquefying natural gas offshore.

The present embodiments meet these needs.

BRIEF DESCRIPTION OF THE DRAWINGS

The detailed description will be better understood in conjunction with the accompanying drawings as follows:

FIG. 7 is a diagram of the communication connections usable with the equipment usable to implement the system.

Figure 1:
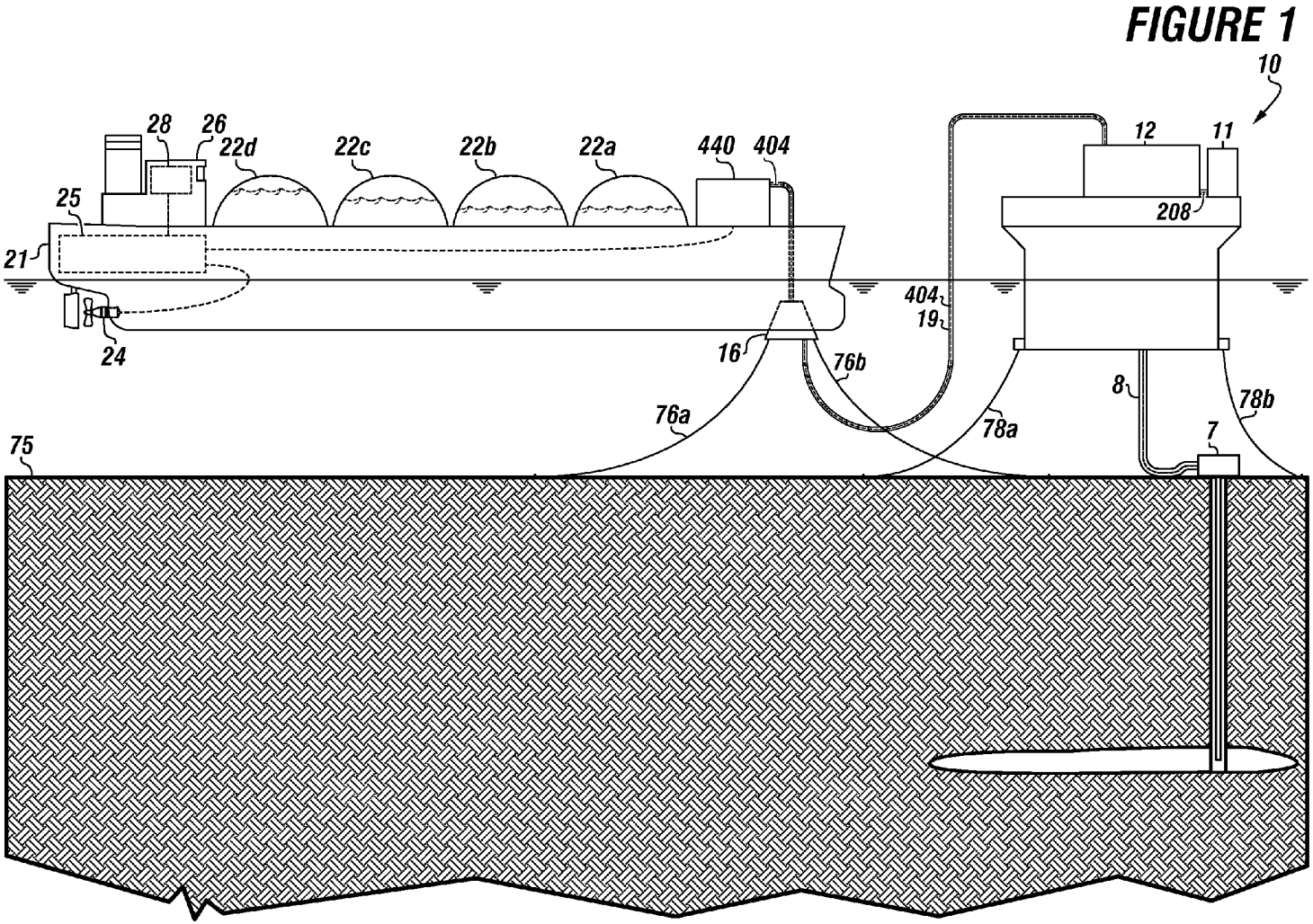
FIG. 1 is a diagram of a disconnectable turret fluidly connected between a moored floating production storage and offloading vessel and a floating liquefaction vessel usable in an embodiment of the system.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The invention relates to a system for offshore liquefaction of natural gas and transport of produced liquefied natural gas using a moored floating production storage and offloading vessel, and a floating liquefaction vessel attached to a disconnectable moored turret, wherein the system improves the fuel efficiency of a dual nitrogen expansion process for liquefying natural gas offshore The invention uses a carbon dioxide refrigeration unit on a moored floating production storage and offloading vessel to pre-cool a high pressure feed gas prior to flowing to a floating liquefaction vessel.

Additionally the invention uses a dual fuel diesel electric power plant of a floating liquefaction vessel to drive the nitrogen compressors of the liquefaction unit on the floating liquefaction vessel.

The dual nitrogen processes used herein are compact, lightweight and safe for use offshore.

The combination of the carbon dioxide refrigeration unit with the use of a dual fuel diesel electric power plant on the floating liquefaction vessel that provides a improved fuel efficiency of the dual nitrogen expansion liquefaction process.

The onboard liquefaction unit is solely powered by a dual fuel diesel electric main power plant of the floating liquefaction vessel.

Alternatively, in areas with relatively benign meta-ocean conditions, the floating liquefaction vessel can be offloaded directly in open water by a dynamically positioned liquefied natural gas shuttle tanker.

Significant natural gas reserves are discovered each year offshore in areas where there is little or no commercial market for the gas on nearby landmass due to the remote location of the natural gas reserves or due to a lack of industrial and commercial infrastructure.

Where the reserves are large enough, conventional onshore liquefied natural gas plants are used to liquefy, store and load the gas onto liquefied natural gas tankers for transport to markets in other countries.

The present system provides a cost effective means of developing small and mid-size offshore gas discoveries in remote regions.

The equipment used in this system can reliably operate not only in benign metocean conditions, but also in ocean conditions with a significant wave height of greater than 3 meters (10 feet).

The system can provide reliable operations in severe metocean conditions because no offshore transfer of liquefied natural gas cargo is required.

For gas liquefaction and liquefied natural gas storage, the system can use one or more modified Moss type liquefied natural gas carriers each moored on a disconnectable turret.

A Moss type liquefied natural gas carrier is proposed for use in this system due to the ability of the spherical tanks to tolerate liquefied natural gas sloshing effects in severe seas, but other liquefied natural gas containment systems such as membrane type systems can be used.

The Moss type liquefied natural gas carrier can utilize a dual fuel diesel electric main power plant for propulsion and, according to this novel system, to power liquefaction.

In one version, the moored floating production storage and offloading vessel can be a ship shaped vessel, a spread moored circular vessel, such as a SEVAN® type, a semisubmersible unit, a barge, or similar vessel, or in shallow water, a fixed platform.

The invention is a fuel efficient floating system for processing natural gas offshore using well gas from an offshore well at sea and a dual nitrogen expansion process for liquefying natural gas offshore. Alternatively, pipeline gas from either onshore or offshore fields can be used as a source of gas for liquefaction.

The system includes a moored floating production storage and offloading vessel for receiving well gas from one or more wells.

A primary processing unit mounted on the moored floating production storage and offloading vessel has several parts.

A production manifold mounted in the primary processing unit on the moored floating production storage and offloading vessel receives the well gas from a subsea flow line forming a wet gas stream.

A primary separation unit receives the wet gas stream and forms a first natural gas stream, a second natural gas stream, a third natural gas stream, a high pressure flash gas stream, a wet condensate, and untreated produced water.

A flash gas compressor receives the first, second and third wet natural gas streams and forms a compressed wet natural gas.

A condensate dehydration unit receives the wet condensate and forms a dry condensate and water.

A water treatment unit receives untreated produced water and forms treated water which can be discharged to the sea.

A condensate stabilizer receives dry condensate and forms stabilized condensate and removed flash gas.

A booster compressor receives flash gas and forms compressed flash gas and transfers the compressed flash gas to the primary separation unit for additional processing.

A gas treatment unit is mounted on the moored floating production storage and offloading vessel for receiving the high pressure flash gas stream from the primary processing unit.

The gas treatment unit has an acid gas removal unit producing sweetened gas and acid gas, a dehydration unit receiving the sweetened gas removing water vapor and producing dry gas.

The gas treatment unit has a dehydration unit receiving the sweetened gas removing water vapor and producing dry gas.

The gas treatment unit has a hydrocarbon dewpoint unit that receives the dry gas and creates feed gas and condensate.

The gas treatment unit has a natural gas export compressor driven by an export gas turbine. The natural gas export compressor receives the feed gas and forms high pressure feed gas The gas treatment unit has a carbon dioxide refrigeration unit that receives the high pressure feed gas from the natural gas export compressor and forms precooled high pressure feed gas.

The system includes a moored disconnectable turret for receiving precooled high pressure feed gas from the gas treatment unit through a flexible conduit.

Removably connected to the moored disconnectable turret is a floating liquefaction vessel that can function as a transport vessel with storage capacity.

The floating liquefaction vessel is a conventional LNG vessel, with helm, controllers, engine room and propulsion system, but is driven by a dual fuel diesel electric main power plant that can be connected either to the ship's electric propulsion motors or to the electric motor driven compressors that run the liquefaction unit.

The liquefaction unit on board the liquefaction and transport vessel has a heat exchanger for receiving pre-cooled high pressure feed gas from the disconnectable turret and forming a liquefied high pressure gas stream, a pre-cooled warm loop nitrogen gas, a pre-cooled cold loop nitrogen gas, a warm loop low pressure nitrogen gas, and a cold loop low pressure nitrogen gas.

A liquid expander receives the liquefied high pressure gas stream from the heat exchanger and expands the liquefied high pressure gas stream forming a low pressure liquefied natural gas stream which is transferred to a storage tank on the floating liquefaction vessel The liquefaction unit on board the liquefaction and transport vessel has a warm loop nitrogen expander that receives the cooled warm loop gas from the heat exchanger and forms a warm loop nitrogen refrigerant which is flowed to the heat exchanger and warmed in the heat exchanger forming the warm loop low pressure nitrogen gas The liquefaction unit on board the liquefaction and transport vessel has a cold loop nitrogen expander that receives the cooled cold loop nitrogen from the heat exchanger and forms a cold loop nitrogen stream refrigerant which is flowed back to the heat exchanger and warmed in the heat exchanger forming the cold loop low pressure nitrogen gas which is then combined with the warm loop low pressure nitrogen gas to make a combined low pressure nitrogen gas.

The liquefaction unit on board the liquefaction and transport vessel has a warm loop nitrogen booster compressor connected to the warm loop nitrogen expander to receive a portion of the combined low pressure nitrogen gas and then compress the portion of the combined low pressure nitrogen gas forming a warm loop intermediate pressure nitrogen gas.

The liquefaction unit on board the liquefaction and transport vessel has a cold loop nitrogen booster compressor connected to the cold loop nitrogen expander for receiving a portion of the combined low pressure nitrogen gas compressing the portion of the combined low pressure nitrogen gas forming a cold loop intermediate pressure nitrogen gas, which is then combined with the warm loop intermediate pressure nitrogen gas forming a combined intermediate pressure nitrogen gas.

The liquefaction unit on board the liquefaction and transport vessel has nitrogen compressor connected to the electric motor wherein the nitrogen compressor compresses the combined intermediate pressure nitrogen gas forming a high pressure nitrogen gas which is then split into a warm loop high pressure nitrogen gas and a cold loop high pressure nitrogen gas. Both the warm loop high pressure nitrogen gas and the cold loop high pressure nitrogen gas are simultaneously flowed to the heat exchanger.

Turning now to the Figures, FIG. 1 is a diagram of a floating liquefaction vessel connected to a disconnectable turret and a moored floating production storage and offloading vessel.

The moored floating production storage and offloading vessel 10 can be connected to a disconnectable turret 16 via a flexible conduit 19 at a first pressure. The first pressure can range from 1000 psia to 1500 psia.

The disconnectable turret 16 can be held to the seafloor 75 using mooring cables 76*a* and 76*b*.

The moored floating production storage and offloading vessel 10 can be moored to the seafloor 75 with mooring cables 78*a* and 78*b*.

The moored floating production storage and offloading vessel 10 can be connected to a well 7 with a subsea flow line 8.

The moored floating production storage and offloading vessel 10 receives natural gas, produced water, and condensate as a mixed stream from the well 7.

The disconnectable turret 16 can receive pre-cooled high pressure feed gas 404 via the flexible conduit 19 from a carbon dioxide refrigeration unit on the moored floating production storage and offloading vessel 10 at a pressure from 1000 psia to 1500 psia and at a temperature from −40 degrees Fahrenheit to 60 degrees Fahrenheit.

A floating liquefaction vessel 21 can be connected in a removable latching manner to the disconnectable turret 16.

The subsea flow line 8 conveys well gas from the well 7 to a primary processing unit 11 on the moored floating production storage and offloading vessel 10.

Figure 2:
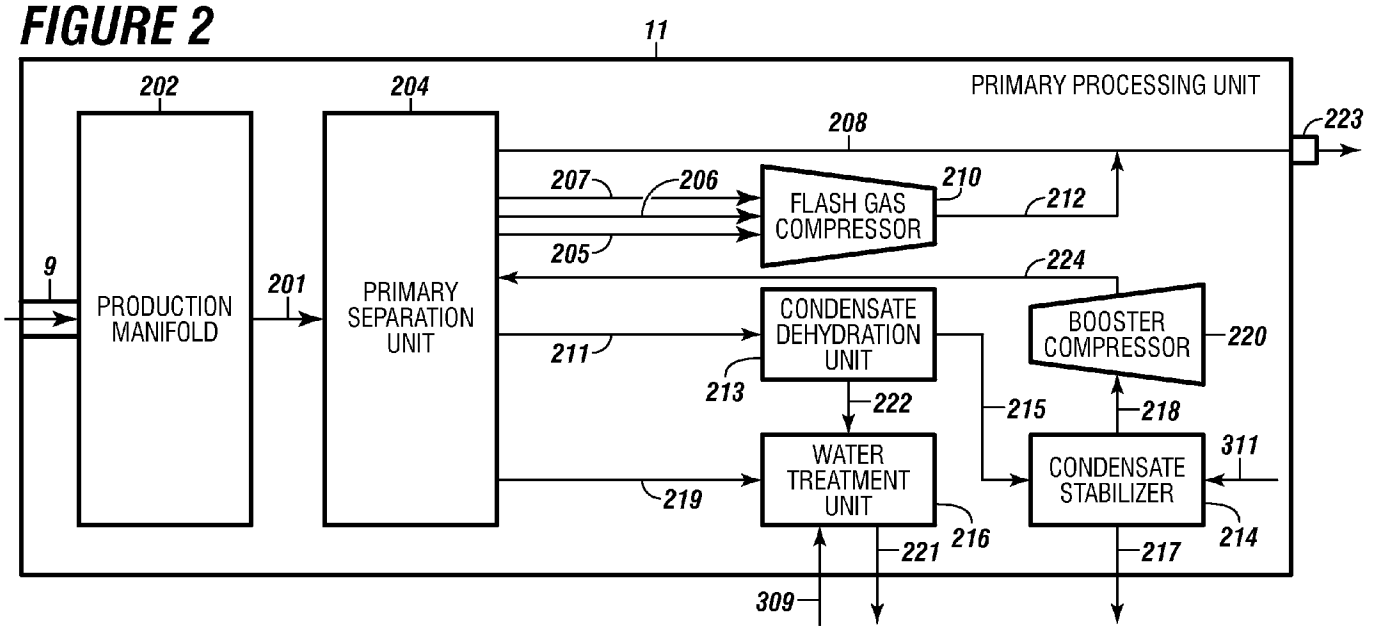
FIG. 2 is a diagram of a primary processing unit on a moored floating production storage and offloading vessel usable in an embodiment of the system.

The primary processing unit 11 produces high pressure flash gas stream 208, and treated water 221 and stabilized condensate 217, which are shown in FIG. 2.

Figure 3:
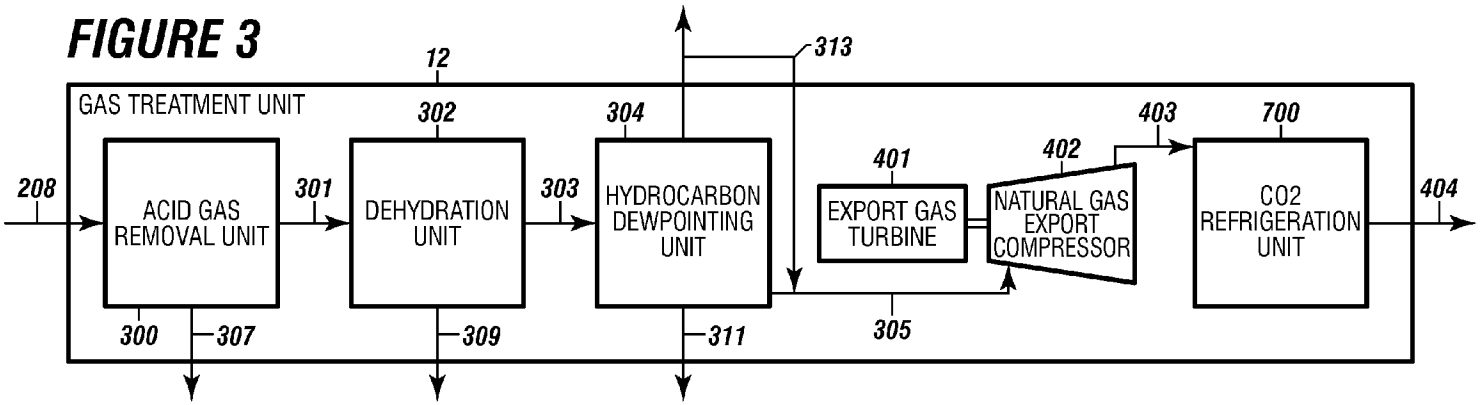
FIG. 3 is a diagram of a gas treating unit on moored floating production storage and offloading vessel usable in an embodiment of the system.

A gas treatment unit 12 shown in detail in FIG. 3, can be mounted on the moored floating production storage and offloading vessel 10 for treating the high pressure flash gas stream 208 to produce pre-cooled high pressure feed gas 404 which is conveyed through flexible conduit 19 to the disconnectable turret 16.

The floating liquefaction vessel 21 has a liquefaction unit 440 for receiving pre-cooled high pressure feed gas 404 from the moored disconnectable turret 16.

Figure 4A:
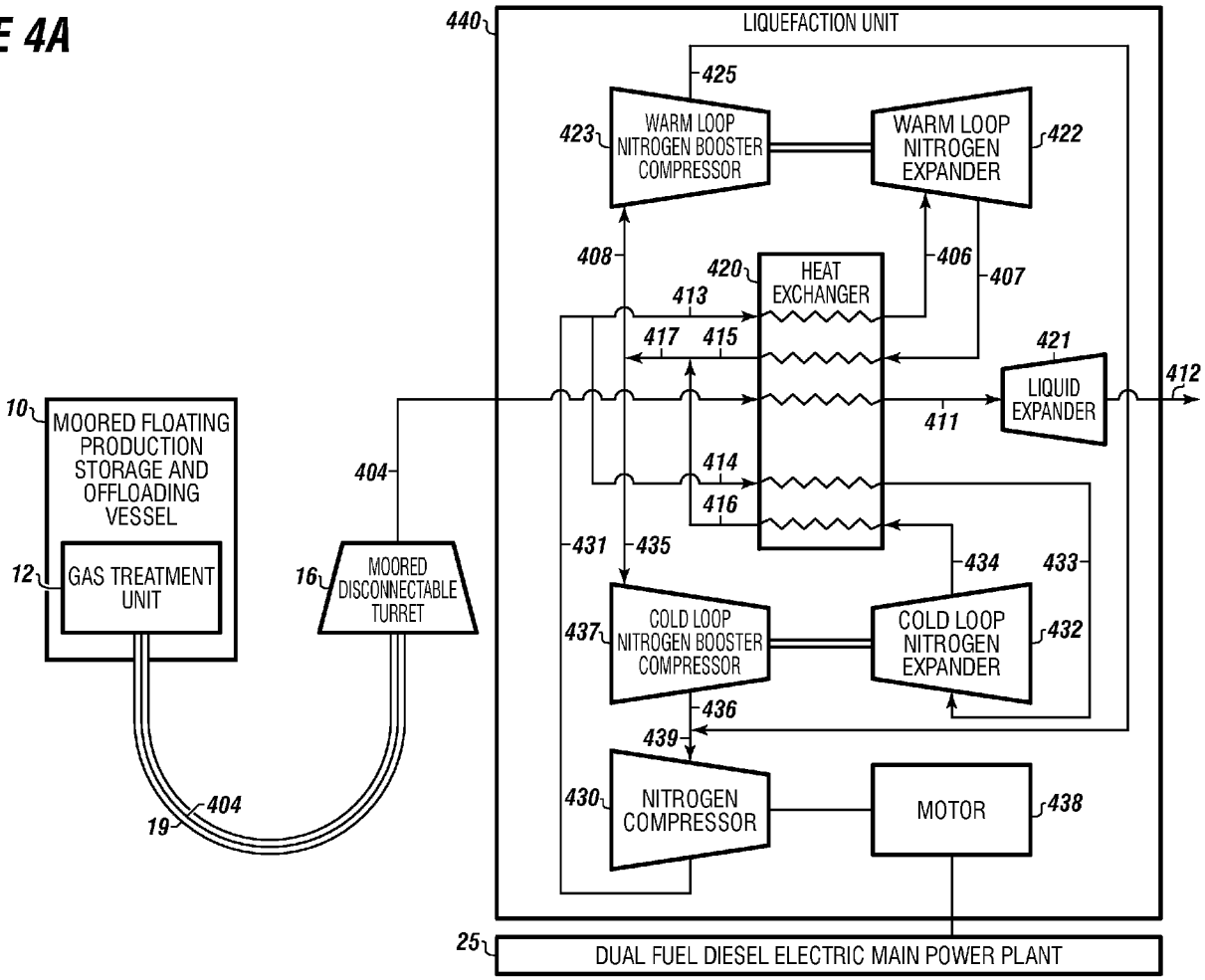
FIG. 4A is a diagram of components of the liquefaction unit mounted to the floating liquefaction vessel which can be used additional as a transport and storage vessel as the floating liquefaction vessel fluidly connects to a disconnectable turret and the disconnectable turret connects to a moored floating production storage and offloading vessel usable in an embodiment of the system.

The pre-cooled high pressure feed gas 404 is transferred to a heat exchanger 420 on the floating liquefaction vessel 21, which is shown in FIG. 4A.

The floating liquefaction vessel 21 has liquefied natural gas storage 22*a*-22*d*, as well as a propulsion means 24, a dual fuel diesel electric main power plant 25 in communication with the propulsion means 24 and a navigation station 26 with a helm 28.

FIG. 2 shows the details of the primary processing unit 11.

The primary processing unit 11 can have a production manifold 202 connected to the subsea flow line for receiving well gas 9, such as natural gas from a well, such as a subsea well, a platform well, or a similar well.

A primary separation unit 204 is connected to the production manifold 202 by a wet gas stream 201.

A flash gas compressor 210 receives a plurality of wet natural gas streams 205, 206, and 207 from the primary separation unit 204.

One of the wet natural gas streams can be a first low pressure wet natural gas at a pressure from 150 psia to 250 psia.

Another of the streams is at second intermediate pressure from 400 psia to 600 psia.

Still another of the streams is a third intermediate pressure wet natural gas having a pressure from 900 psia to 1200 psia.

The flash gas compressor 210 can compress the wet natural gases from the wet natural gas streams 205, 206, and 207 and form compressed wet natural gas 212.

A high pressure flash gas stream 208 can flow directly from the primary separation unit 204 to an outlet 223. The high pressure flash gas can be flowed at a pressure from 1500 psia to 2000 psia.

The wet condensate 211 is transferred from the primary separation unit 204 to a condensate dehydration unit 213 forming an unstabilized dry condensate 215.

Water 222 is transferred from the condensate dehydration unit 213 to a water treatment unit 216. The water treatment unit 216 forms treated water 221.

Water vapor 309 flows from a dehydration unit 302 in the gas treatment unit 12 which is detailed in FIG. 3.

A condensate stabilizer 214 is used for receiving pentanes and heavier hydrocarbon compounds, which group is referred to as "$C5_+$", such as condensate 311, and the unstabilized dry condensate 215. The condensate 311 is formed by a hydrocarbon dewpointing unit in the gas treatment unit 12 shown in FIG. 3.

The stabilized condensate 217 is flowed to storage in the hull of the of the floating production storage and offloading vessel while sending removed flash gas 218 to a booster compressor 220 and then to the primary separation unit 204 as compressed flash gas 224.

The water treatment unit 216 is connected to the primary separation unit 204. The water treatment unit 216 can receive untreated produced water 219 from the primary separation unit 204, from the condensate dehydration unit 213 and from the gas dehydration unit 302 and forms treated water 221, which can be discharged to the sea.

FIG. 3 is a diagram of the gas treatment unit 12 on the moored floating production storage and offloading vessel.

The gas treatment unit 12 can have an acid gas removal unit 300 can be mounted on the first moored floating production storage and offloading vessel 10.

The acid gas removal unit 300 can receive the high pressure flash gas stream 208 from the primary processing unit.

The acid gas removal unit 300 removes acid gas 307, such as $CO_2$ and/or $H_2S$ for venting, flaring or disposal.

A dehydration unit 302 receives sweetened gas 301 from the acid gas removal unit 300 and removes water vapor 309 to produce dry gas 303.

The water vapor 309 from the dehydration unit 302 is sent to the water treatment unit 216 shown in FIG. 2.

A hydrocarbon dewpointing unit 304 receives the dry gas 303 and removes heavy hydrocarbon compounds, such as but not limited, to propane ($C_3$), butane ($C_4$), and pentanes plus ($C_{5+}$), forming the feed gas 305.

The propane and butane can be blended into a liquefied natural gas feed 313, or sent to storage to be sold as a separate product stream. The terms "propane" and "butane" are abbreviated herein as "$C_3$" and "$C_4$" respectively and are often referred to collectively as "liquefied petroleum gas".

Condensate 311 from the hydrocarbon dewpointing unit 304 is removed and sent to the condensate stabilizer 214 as shown in FIG. 2. The condensate 311 typically contains $C_5$ and heavy hydrocarbons, usually referred to as "pentanes plus" and abbreviated as "$C_{5+}$".

An export gas turbine 401 drives a natural gas export compressor 402 that receives feed gas 305 and forms a high pressure feed gas 403.

High pressure feed gas 403 is sent to a carbon dioxide refrigeration unit 700 to form a pre-cooled high pressure feed gas 404.

FIG. 4A is a diagram of components of a liquefaction unit 440 located on the floating liquefaction vessel fluidly connected to the moored disconnectable turret 16.

The disconnectable turret is fluidly connected through flexible conduit 19 to the moored floating production storage and offloading vessel 10 with the gas treatment unit 12.

The gas treatment unit 12 produces a pre-cooled high pressure feed gas 404. This high pressure feed gas is conveyed through the flexible conduit 19 to the disconnectable turret 16.

The disconnectable turret conveys the pre-cooled high pressure feed gas 404 to a heat exchanger 420 in the liquefaction unit 440.

The heat exchanger 420 cools the pre-cooled high pressure feed gas 404 producing a liquefied high pressure gas stream 411.

The liquefied high pressure gas stream 411 is flowed through a liquid expander 421 forming a low pressure liquefied natural gas stream 412 which can be sent to liquefied natural gas storage.

High pressure nitrogen gas 431 from the nitrogen compressor 430 is divided into a warm loop high pressure nitrogen gas 413 and a cold loop high pressure nitrogen gas 414, wherein both gases flow to the heat exchanger 420.

A warm loop nitrogen expander 422 receives a cooled warm loop gas 406 from the heat exchanger 420 and transmitting a warm loop nitrogen refrigerant 407 to the heat exchanger 420 which is then warmed to form warm loop low pressure nitrogen gas 415.

A warm loop nitrogen booster compressor 423 can be connected to the warm loop nitrogen expander 422

A cold loop nitrogen expander 432 receives a cooled cold loop nitrogen 433 from the heat exchanger 420 and transmitting a cold loop nitrogen stream refrigerant 434 to the heat exchanger 420 which is then warmed to form cold loop low pressure nitrogen gas 416.

A cold loop nitrogen booster compressor 437 is connected to the cold loop nitrogen expander 432

The cold loop low pressure nitrogen gas 416 is then combined with the warm loop low pressure nitrogen gas 415 to make combined low pressure nitrogen gas 417.

A warm loop compressor 423 receives a portion of the combined low pressure nitrogen gas 417 and the cold loop nitrogen booster compressor 437 receives the balance of the combined low pressure nitrogen gas 417.

The portion going to the warm loop compressor is typically 70 to 80% of the stream of gas.

The warm loop nitrogen expander 422 powers the warm loop nitrogen booster compressor 423.

The warm loop nitrogen booster compressor 423 forms a warm loop intermediate pressure nitrogen gas 425.

A cold loop compressor 437 receives the balance of the combined low pressure nitrogen gas 417.

The cold loop nitrogen expander 432 powers the cold loop nitrogen booster compressor 437.

The cold loop nitrogen booster compressor 437 forms a cold loop intermediate pressure nitrogen gas 436.

The cold loop intermediate pressure nitrogen gas 436 is blended with the warm loop intermediate pressure nitrogen gas 425 forming a combined intermediate pressure nitrogen gas 439 that is transferred to a nitrogen compressor 430 forming high pressure nitrogen gas 431.

The nitrogen compressor 430 is powered by a motor 438 which is connected to a dual fuel diesel electric main power plant 25 of the floating liquefaction vessel.

In embodiments, the floating liquefaction vessel has a propulsion means connected to a dual fuel power supply which can be a diesel electric main power plant or a steam turbo-electric plant. The dual fuel diesel electric main power plant or steam turbo-electric plant is electrically connected to the liquefaction unit 440.

Figure 4B:
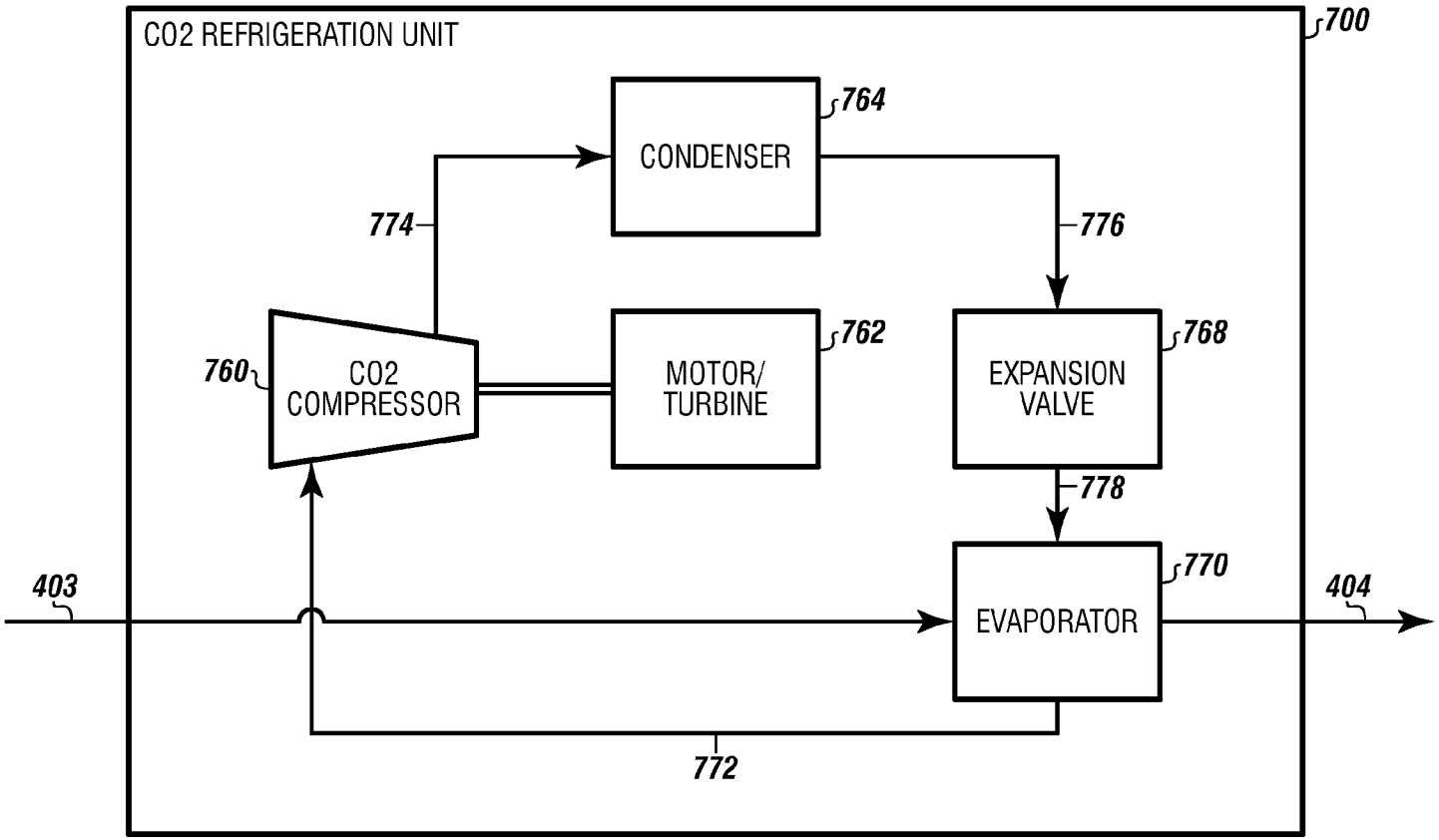
FIG. 4B is a detail of a carbon dioxide refrigeration unit usable in the system.

FIG. 4B shows details of a carbon dioxide refrigeration unit 700 that produces pre-cooled high pressure feed gas 404 from high pressure feed gas 403 of the gas treatment unit.

The high pressure feed gas 403 is transferred to an evaporator 770.

The evaporator 770 sends low pressure carbon dioxide gas 772 to a carbon dioxide compressor 760. The carbon dioxide compressor is driven by a motor or turbine 762.

High pressure carbon dioxide gas 774 is flowed from the carbon dioxide compressor 760 to a condenser 764 forming high pressure carbon dioxide refrigerant 776.

The high pressure carbon dioxide refrigerant 776 is flowed through an expansion valve 768 to form cold carbon dioxide refrigerant 778.

The cold carbon dioxide refrigerant 778 flows to the evaporator 770 to cool the high pressure feed gas 403 forming the pre-cooled high pressure feed gas 404.

Figure 5:
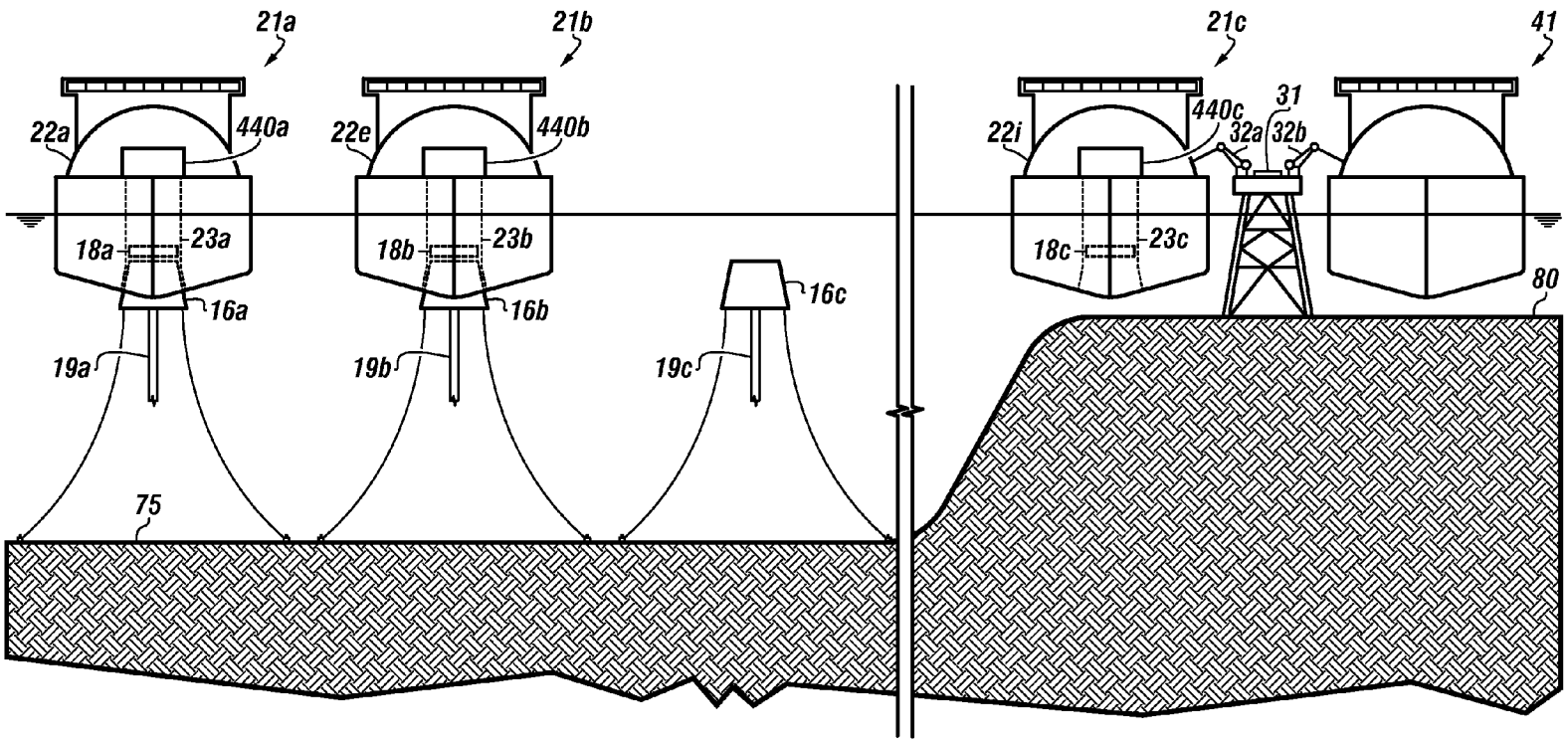
FIG. 5 is a diagram depicting the offloading arrangements and transfer jetty using a plurality of floating liquefaction vessels and a plurality of disconnectable turrets usable in an embodiment of the system.

FIG. 5 is a diagram depicting off-loading arrangements and a transfer jetty using a plurality of floating liquefaction vessels 21 and a plurality of disconnectable turrets 16.

A plurality of floating liquefaction vessels 21*a*, 21*b*, and 21*c* are shown.

Floating liquefaction vessels 21*a* and 21*b* are connected to disconnectable turrets 16*a* and 16*b* respectively.

Disconnectable turret 16*b* can connect to a flexible conduit 19*b* that can also engage the moored floating production storage and offloading vessel 10 of FIG. 1.

A third disconnectable turret 16*c* is depicted with the floating liquefaction vessel disconnected.

The disconnectable turret 16*c* has a flexible conduit 19*c* in fluid communication with the moored floating production storage and offloading vessel 10 of FIG. 1.

Each floating liquefaction vessel 21*a*-21*c* has a liquefaction unit 440*a*-440*c*.

Each liquefaction unit 440*a*-440*c* is electrically connected to the dual fuel diesel electric main power plant of the floating liquefaction vessel.

The floating liquefaction vessel 21*a* has liquefaction unit 440*a* as well as a plurality of liquefied natural gas storage, one of which, storage unit 22*a* is shown. The vessel also has a turret receptacle 23*a* and a means to recover (pick up out of the sea) and latch onto the disconnectable turret (which is not shown).

The turret can be buoyant.

The turret receptacle has fluid swivels 18*a*, 18*b* and 18*c* that can be gas swivels, and piping that can be connected and disconnected to the disconnectable turret to provide a fluid connection with the disconnectable turret.

Each of the fluid swivels can be conveniently and quickly connectable and disconnectable with the fluid conduits in the disconnectable turret.

The floating liquefaction vessel 21*b* has a liquefaction unit 440*b*, which is electrically connected to the dual fuel diesel electric main power plant.

The floating liquefaction vessel 21*b* has a liquefied natural gas storage 22*e* shown as well as, a turret receptacle 23*b*, and a means to recover and latch onto the disconnectable turret (which is not shown). The turret receptacle 23*b* can be identical to the turret receptacle 23*a*. The turret receptacle 23*b* has a fluid swivel 18*b*.

A floating liquefaction vessel 21*c* has a liquefaction unit 440*c*, which is electrically connected to the dual fuel diesel electric main power plant of the vessel.

The vessels 21*a* and 21*b* are depicted connected to the turrets which are moored in deep water above a sea floor 75.

The floating liquefaction vessel 21*c* has a liquefied natural gas storage 22*i* depicted, a turret receptacle 23*c*, and a fluid swivel 18*c* in the turret receptacle. The vessel has a means to recover and latch onto the disconnectable turret which is not shown.

In the Figure, floating liquefaction vessel 21*c* is connected to a transfer terminal 31.

A transfer terminal 31 is shown secured to the shallow seafloor 80 in sheltered or calm, water such as from 50 feet to 200 feet.

Transfer terminal 31 has articulated liquefied natural gas loading arms 32*a* and 32*b* depicted. Articulated liquefied natural gas loading arm 32*a* is shown connected to the liquefied natural gas transfer vessel 21*c*.

Articulated liquefied natural gas loading arm 32*b* is shown connected to a liquefied natural gas trading tanker 41 for receiving the cargo from the floating liquefaction vessel 21*c*.

In one or more embodiments, the articulated liquefied natural gas loading arms can be replaced with hoses.

In other embodiments, in benign water with predominant wave height less than 2 meters, a dynamically positioned shuttle tanker can be used to directly connect to the floating liquefaction vessels and offload in a side by side or tandem configuration.

Figure 6A:
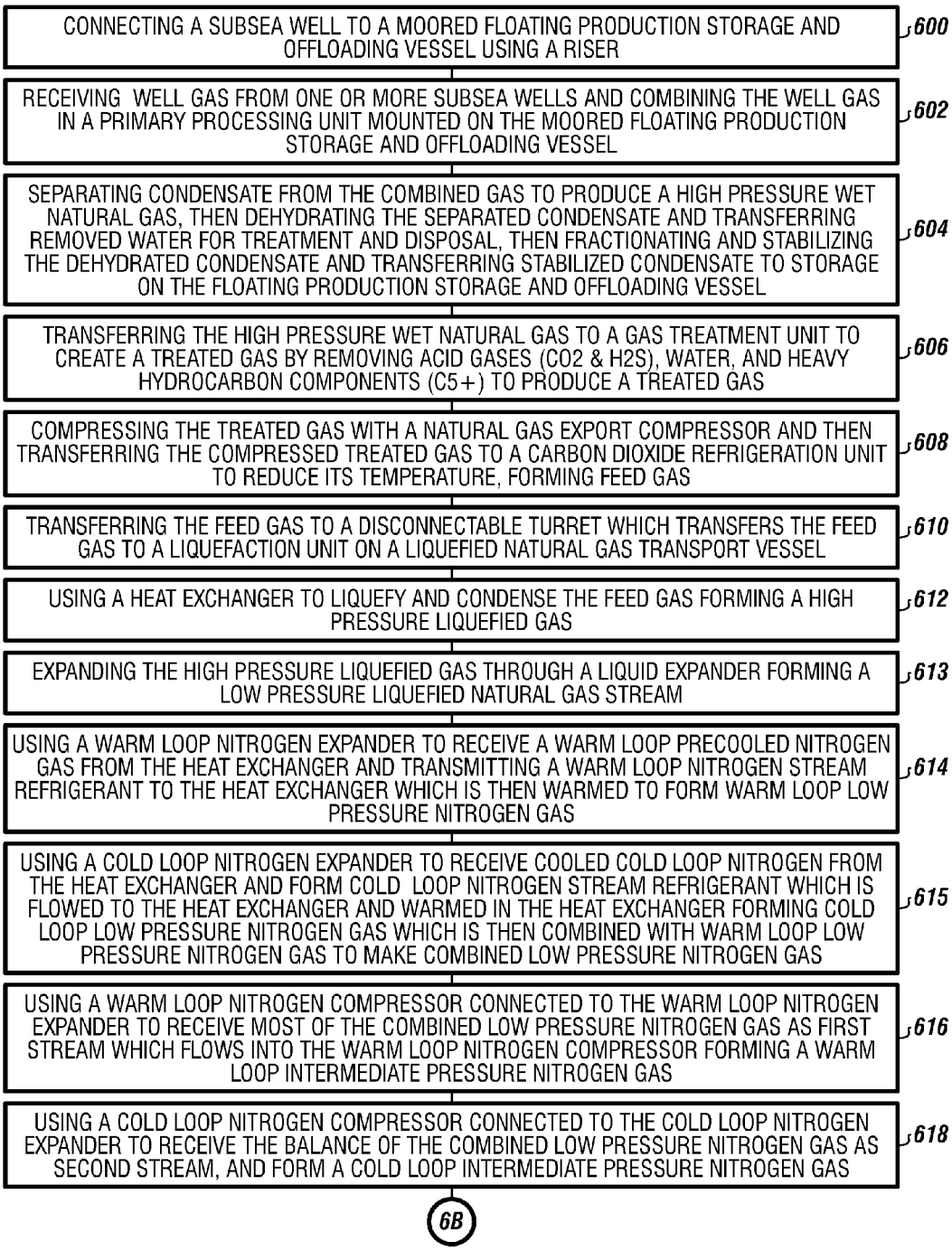
FIGS. 6A and 6B are a diagram of a sequence of steps used in an embodiment of the system.
Figure 6B:
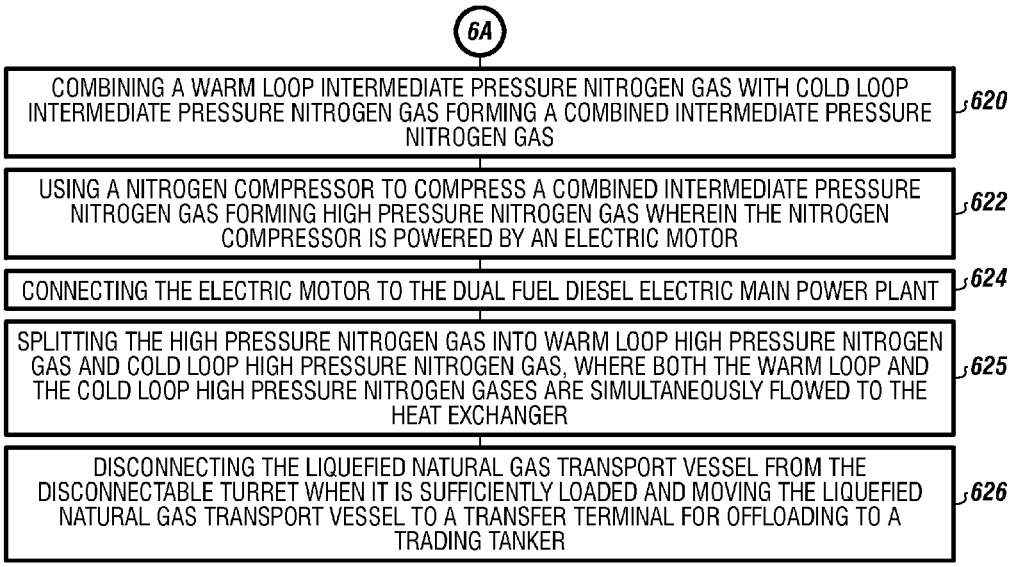

FIGS. 6A and 6B are a diagram of the sequence of steps that can be usable with the equipment already discussed.

The system can include connecting a subsea well to a moored floating production storage and offloading vessel using a riser, as shown in step 600.

The system can include receiving well gas from one or more subsea wells and combining the well gas in a primary processing unit mounted on the moored floating production storage and offloading vessel, as shown in step 602.

The system can include separating condensate from the combined gas to produce a high pressure wet natural gas, then dehydrating the separated condensate and transferring removed water for treatment and disposal, then fractionating and stabilizing the dehydrated condensate and transferring stabilized condensate to storage on the moored floating production storage and offloading vessel, as shown in step 604.

The system can include transferring the high pressure wet natural gas to a gas treatment unit to create a treated gas by removing acid gases (CO2 & H2S), water, and heavy hydrocarbon components ($C5_{+}$) to produce a treated gas, as shown in step 606.

The system can include compressing the treated gas with a natural gas export compressor and then transferring the compressed treated gas to a carbon dioxide refrigeration unit to reduce its temperature, forming feed gas, as shown in step 608.

The system can include transferring the feed gas to a disconnectable turret which transfers the feed gas to a liquefaction unit on a floating liquefaction vessel, as shown in step 610.

The system can include using a heat exchanger to liquefy and condense the feed gas forming a high pressure liquefied gas, as shown in step 612.

The system can include expanding the high pressure liquefied gas through a liquid expander forming a low pressure liquefied natural gas stream, as shown in step 613.

The system can include using a warm loop nitrogen expander to receive a warm loop precooled nitrogen gas from the heat exchanger and transmitting a warm loop nitrogen stream refrigerant to the heat exchanger which is then warmed to form warm loop low pressure nitrogen gas, as shown in step 614.

The system can include using a cold loop nitrogen expander to receive a cold loop precooled nitrogen gas from the heat exchanger and form cold loop nitrogen refrigerant which is flowed to the heat exchanger and warmed forming cold loop low pressure nitrogen gas which is then combined with warm loop low pressure nitrogen gas to make combined low pressure nitrogen gas, as shown in step 615.

The system can include using a warm loop nitrogen booster compressor connected to the warm loop nitrogen expander to receive most of the combined low pressure nitrogen gas from the heat exchanger and form an intermediate pressure nitrogen gas, as shown in step 616.

The system can include using a cold loop nitrogen booster compressor connected to the cold loop nitrogen expander to receive the balance of the combined low pressure nitrogen gas from the heat exchanger and form an intermediate pressure nitrogen gas, as shown in step 618.

The system can include combing the two intermediate pressure nitrogen streams from the warm loop compressor and cold loop compressor forming combined intermediate pressure nitrogen gas, as shown in step 620.

The system can include using a nitrogen compressor for compressing the combined intermediate pressure nitrogen gas forming a high pressure nitrogen gas wherein the nitrogen compressor is powered by an electric motor, as shown in step 622.

The system can include connecting the electric motor to the dual fuel diesel electric main power plant, as shown in step 624.

The system can include splitting the high pressure nitrogen gas into a warm loop high pressure nitrogen gas and a cold loop high pressure nitrogen gas, where both gases are simultaneously flowed to the heat exchanger, as shown in step 625.

The system can include disconnecting the floating liquefaction vessel from the disconnectable turret when it is sufficiently loaded and moving the floating liquefaction vessel to a transfer terminal for offloading to a trading tanker, as shown in step 626.

In embodiments, the system enables the floating liquefaction vessel to quickly disconnect from the disconnectable turret, transit to sheltered water and discharge cargo to at least one liquefied natural gas trading tanker in sheltered water, avoiding offshore transfer of liquefied natural gas.

In one or more embodiments, a fixed production storage and offloading platform can be used instead of the moored floating production storage and offloading vessel.

The fixed production storage and offloading platform can have a primary processing unit mounted on the fixed production storage and offloading platform for receiving gas from a well; a gas treatment unit mounted on the fixed production storage and offloading platform for treating a process stream from the primary processing unit to produce treated inlet gas streams; and a first liquefaction portion that includes a natural gas compressor for receiving liquefied natural gas inlet quality gas, forming a high pressure liquefied natural gas inlet quality gas at a pressure from 1200 psia to 2000 psia. The platform can connect in a manner identical to the moored floating production storage and offloading vessel to the disconnectable turrets as shown in prior Figures.

FIG. 7 depicts the electronic communications usable to perform the invention.

The floating liquefaction vessel has a processor 52 which connects to a controller 33 for operating the liquefaction unit 440 and to communicate with the helm 28. The helm connects to a network 61 which communicates to a remote server 62. The remote server has a processor 52 and data storage 54 for monitoring the liquefaction process and the loading of the tanker.

The processor 52 communicates with an onboard data storage 54 in order to use computer instructions to communicate with the moored disconnectable turret 16, the primary processing unit 11, and the gas treatment unit 12.

The onboard data storage has computer instructions 55 to communicate commands and sensor information between the floating liquefaction vessel and the moored disconnectable turret.

The onboard data storage 54 also has computer instructions 56 to communicate commands and sensor information between the floating liquefaction vessel and the primary processing unit.

The onboard data storage 54 also has computer instructions 57 to communicate commands and sensor information between the floating liquefaction vessel and the gas treatment unit.

The onboard data storage 54 also has computer instructions 58 to create a display in real time of the sensor information and commands and transmit the display to client devices, such as the remote server via the network.

Like the remote server, client devices have processors and a data storage. Client devices can be computers. The remote server can be a computer. The onboard processor with data storage can be a computer. Other usable client devices include Ipads, cellular phones, and personal computing devices.

The network can be a satellite network, a cellular network, the internet or combinations of these networks.

While these embodiments have been described with emphasis on the embodiments, it should be understood that within the scope of the appended claims, the embodiments might be practiced other than as specifically described herein.

What is claimed is:

1. A fuel efficient floating system for processing natural gas offshore using well gas from a well at sea using a dual nitrogen expansion process for liquefying natural gas offshore, the system comprising:

a. a moored floating production storage and offloading vessel for receiving well gas from one or more wells;

b. a primary processing unit mounted on the moored floating production storage and offloading vessel, the primary processing unit comprising:

(i) a production manifold receives the well gas from a subsea flow line forming a wet gas stream;

(ii) a primary separation unit receives the wet gas stream and forms a first natural gas stream, a second natural gas stream, a third natural gas stream, a high pressure flash gas stream, a wet condensate, and untreated produced water;

(iii) a flash gas compressor receives the first natural gas stream, the second natural gas stream, the third natural gas stream and forms a compressed wet natural gas;

(iv) a condensate dehydration unit receives the wet condensate and forms a dry condensate and water;

(v) a water treatment unit receives the untreated produced water, the water, and condensed water vapor and forms treated water which is discharged to the sea;

(vi) a condensate stabilizer receives the dry condensate and forms stabilized condensate and removed flash gas; and (vii) a booster compressor receives the removed flash gas and forms compressed flash gas and transfers the compressed flash gas to the primary separation unit for additional processing;

c. a gas treatment unit mounted on the moored floating production storage and offloading vessel for receiving the high pressure flash gas stream comprising:

(i) an acid gas removal unit produces sweetened gas and acid gas;

(ii) a dehydration unit receives the sweetened gas, removes water vapor and produces dry gas;

(iii) a hydrocarbon dewpoint unit receives the dry gas and creates feed gas, condensate and liquefied natural gas feed;

(iv) a natural gas export compressor driven by an export gas turbine receives the feed gas and forms high pressure feed gas; and (v) a carbon dioxide refrigeration unit receives the high pressure feed gas and forms precooled high pressure feed gas;

d. a moored disconnectable turret for receiving the precooled high pressure feed gas through a flexible conduit;

e. a floating liquefaction vessel connected to the moored disconnectable turret, the floating liquefaction vessel comprising:

(i) a dual fuel diesel electric main power plant connected to an electric motor; and (ii) a liquefaction unit connected to the electric motor, the liquefaction unit comprising:

1. a heat exchanger receives the pre-cooled high pressure feed gas from the disconnectable turret and forming a liquefied high pressure gas stream, a pre-cooled warm loop gas, a pre-cooled cold loop nitrogen, a warm loop low pressure nitrogen gas, and a cool loop low pressure nitrogen gas;

2. a liquid expander receives the liquefied high pressure gas stream expanding the liquefied high pressure gas stream forming a low pressure liquefied natural gas stream which is transferred to a storage tank on the floating liquefaction vessel;

3. a warm loop nitrogen expander receives the precooled warm loop gas from the heat exchanger and forms a warm loop nitrogen refrigerant which is flowed to the heat exchanger and warmed in the heat exchanger forming the warm loop low pressure nitrogen gas;

4. a cold loop nitrogen expander receives the precooled cold loop nitrogen from the heat exchanger and forms a cold loop nitrogen stream refrigerant which is flowed to the heat exchanger and warmed in the heat exchanger forming the cold loop low pressure nitrogen gas which is then combined with the warm loop low pressure nitrogen gas to make combined low pressure nitrogen gas;

5. a warm loop nitrogen booster compressor connects to the warm loop nitrogen expander to receive a portion of the combined low pressure nitrogen gas compressing the portion of the combined low pressure nitrogen gas forming a warm loop intermediate pressure nitrogen gas;

6. a cold loop nitrogen booster compressor connects to the cold loop nitrogen expander and receives a portion of the combined low pressure nitrogen gas compressing the portion of the combined low pressure nitrogen gas forming a cold loop intermediate pressure nitrogen gas, which is then combined with the warm loop intermediate pressure nitrogen gas forming a combined intermediate pressure nitrogen gas; and 7. a nitrogen compressor connected to the electric motor compresses the combined intermediate pressure nitrogen gas forming a high pressure nitrogen gas which is then split into a warm loop high pressure nitrogen gas and a cold loop high pressure nitrogen gas, where both the warm loop high pressure nitrogen gas and the cold loop high pressure nitrogen gas are simultaneously flowed to the heat exchanger; and f. wherein the system enables the floating liquefaction vessel to quickly disconnect from the disconnectable turret, transit to sheltered water and discharge cargo to at least one liquefied natural gas trading tanker in sheltered water, avoiding offshore transfer of liquefied natural gas.

2. The system of claim 1, further comprising a processor in communication with the liquefaction unit, the gas treatment unit, and the primary processing unit using a network to communicate with a remote processor enabling remote monitoring of the processing of the natural gas on the floating liquefaction vessel.

3. The system of claim 1, further comprising a turret receptacle and a means to recover and latch onto the disconnectable turret incorporated into the floating liquefaction vessel.

4. The system of claim 1, wherein the carbon dioxide refrigeration unit further comprises: an evaporator for receiving the high pressure feed gas forming low pressure carbon dioxide gas; a carbon dioxide compressor driven by a motor, is connected to the evaporator, receives the low pressure carbon dioxide gas and forms high pressure carbon dioxide gas; a condenser, connected to the carbon dioxide compressor, receives the high pressure carbon dioxide gas and forms high pressure carbon dioxide refrigerant, and an expansion valve, connected to the condenser, receives the high pressure carbon dioxide refrigerant and forms cold carbon dioxide refrigerant which is transferred to the evaporator forming the pre-cooled high pressure feed gas.

* * * * *